United States Patent [19]

Huchzermeier

[11] 4,428,318

[45] Jan. 31, 1984

[54] VENTILATION ARRANGEMENT FOR A CARGO SHIP

[75] Inventor: Hans M. Huchzermeier, Bremen, Fed. Rep. of Germany

[73] Assignee: Bremer Vulkan Schiffbau and Maschinenfabrick, Bremen, Fed. Rep. of Germany

[21] Appl. No.: 913,011

[22] Filed: Jun. 6, 1978

[30] Foreign Application Priority Data

Jun. 10, 1977 [DE] Fed. Rep. of Germany ..... 2726076

[51] Int. Cl.[3] ..... B63J 2/00

[52] U.S. Cl. ..... 114/211

[58] Field of Search ..... 114/211, 72; 62/238, 62/239, 240, 298, 299, 409, 62, 418; 220/1.5; 98/6, 33 R; 165/108

[56] References Cited

U.S. PATENT DOCUMENTS

| | | | |
|---|---|---|---|
| 3,115,019 | 12/1963 | Rutishauser | 62/418 |
| 3,359,752 | 12/1967 | Westling et al. | 62/239 |
| 3,440,834 | 4/1969 | Hirai et al. | 62/240 |
| 3,489,119 | 1/1970 | Wemmerus | 114/211 |
| 3,624,736 | 11/1971 | Iwami | 114/72 |
| 3,692,100 | 9/1972 | Gallagher | 62/240 |
| 3,970,209 | 7/1976 | Baxter | 220/1.5 |
| 4,012,922 | 3/1977 | Falensky | 62/240 |
| 4,122,761 | 10/1978 | Westin et al. | 98/33 R |

FOREIGN PATENT DOCUMENTS

| | | | |
|---|---|---|---|
| 2721327 | 8/1980 | Fed. Rep. of Germany | 62/239 |
| 240507 | 10/1925 | United Kingdom | 62/239 |

*Primary Examiner*—Sherman D. Basinger
*Assistant Examiner*—Jesús D. Sotelo
*Attorney, Agent, or Firm*—Christie, Parker & Hale

[57] ABSTRACT

A ventilation arrangement for a cargo ship includes at least one air circulation system for circulating air from a ventilation source into and out of the cargo. The ventilation source may include a refrigeration plant. The circulation system includes air supply and air exhaust ducts in the cargo hold. Container guides are located in the hold for receiving and aligning a number of cargo containers adjacent at least the air ducts. The container guides are also useful for receiving and positioning a plurality of cargo pallets; each pallet has a load-bearing surface on which break-bulk and other cargo can be placed. Each pallet load-bearing surface is defined by a hollow ventilation base which, as the pallet is positioned in the container guides can be connected by a suitable connection to an adjacent air supply duct. Openings are provided through the load-bearing surface of each pallet from the interior of the base for flow of air from the base into the cargo area of the pallet.

22 Claims, 8 Drawing Figures

VENTILATION ARRANGEMENT FOR A CARGO SHIP

BACKGROUND OF THE INVENTION

1. Field of the Invention

This invention pertains to forced-air ventilation systems for cargo in cargo ships. More particularly, it pertains to a ventilation system which is useful with normal cargo and also, if desired, with containerized cargo. The system can be of either the open-loop or closed-loop type.

2. Review of the Prior Art

Cargo ships having air supply and exhaust duct systems, by which air can be supplied from a ventilation source via individual connections to large-scale cargo containers and by which air can be vented from the containers and led back to the source, are known. In such ships, container guides are located in the hold spaces for accommodating and aligning a number of containers, usually in a series of vertical stacks, adjacent the air supply and exhaust ducts so that separate air supply and exhaust connections can be made to the individual containers from the ducts. In these ships, the ventilation source can include a refrigeration plant coupled to at least some of the air supply ducts so that containers loaded with perishable cargo can be refrigerated during their residence aboard the ship. Other containers with less sensitive cargo can receive unrefrigerated air, and can vent exhaust air to the atmosphere if desired.

The practical disadvantage which exists with cargo ships having such hold-space ventilation arrangements is that the ships are designed exclusively as container ships; the ships are designed to receive only containers of a standardized configuration, which are relatively large. Such container ships have no intermediate decks in the hold spaces. They are designed to support containers in vertical stacks which extend from the vessel innerbottom to hatches located in the weatherdeck of the ship.

If it is desired to transport cargo in other forms, i.e., loose cargo, cargo in separate small containers, cargo in cartons or crates, or cargo on standard pallets, then it is necessary to use other ships which have intermediate or 'tween decks in the hold spaces. These other ships, however, are rarely capable of accommodating standard containers in their holds.

The trend in the maritime industry, world-wide, is toward increased containerization of cargo. Clearly, container-ships have a place and may be ideal in many situations, as in runs between Hawaii and the West Coast of the United States. However, there are many situations where ships of more generalized nature, suited for carrying containers as well as other forms of cargo, have application and are economically more desirable than container-ships.

Thus, a need is seen to exist for cargo ships of generalized nature, capable of carrying both containers and other forms of non-bulk cargo, having improved and innovative ventilation systems which are useful with containers and which also are useful, in a way not heretofore suggested, with cargo in other forms. Such ships would fill a distinct need in the world's marine shipping industry.

SUMMARY OF THE INVENTION

This invention addresses the need identified above. It provides a ventilation arrangement for a cargo ship capable of accommodating standard containers and also other forms of non bulk cargo, in an efficient and effective cooperation with the ventilation arrangement.

Generally speaking, this invention provides a ventilation arrangement for an enclosed hold space of a cargo ship. The ventilation arrangement comprises at least one circulation system by which air can be conveyed from a ventilation source through air supply ducts into a ship cargo hold space, and can be returned as exhaust air through exhaust ducts to the ventilation source. A plurality of pallets are provided. Each pallet has a hollow ventilation base defining a top load-bearing surface for support of cargo thereon. Guide means in the hold space are provided for receiving corners of the pallet bases and for aligning the pallet bases with outlet openings from the air supply ducts. The guide means are also cooperable with standard cargo containers for receiving and aligning the containers with the air supply duct openings. Each pallet base has at an end thereof into the interior thereof an air inlet opening which is cooperable with a supply duct outlet opening for air flow into the pallet base from a supply duct. Each pallet base also has, at least through the load-bearing surface thereof, airflow opening means from the base interior.

This invention also provides a marine cargo pallet. The pallet comprises a hollow base of standardized substantially rectangular plan configuration and dimension. An air inlet opening is provided laterally into the base interior at one end of the base. The structure of the pallet which defines the air inlet opening is substantially flush with the adjacent end of the base so as not to project significantly laterally from the base. The base has a top load-bearing surface. Air flow outlet means are provided at least through the base top surface from the interior of the base. The base is closed save for the end air inlet opening and the opening means in its top surface to serve as a plenum for flow of air therethrough from the opening to the opening means.

The container guides can be used, as desired, to accommodate either standard containers in a stacked manner or pallets in an individually supported manner. Thus, cargo of any type can be ventilated by the ventilation system which can, if desired, include a refrigeration plant as an aspect of the ventilation source. A single ship can handle various types of freight or cargo which is to be cooled or ventilated in transit.

DESCRIPTION OF THE DRAWINGS

The above-mentioned and other features of the invention are more fully set forth and made apparent in the following detailed description of certain embodiments of the invention, including the embodiment presently preferred. This description is presented with reference to the accompanying drawings, wherein.

DESCRIPTION OF THE ILLUSTRATED EMBODIMENTS

The ventilation arrangement which is herein described, but which is depicted substantially diagrammatically in the accompanying drawings, is an aspect of a cargo ship.

Figure 1:
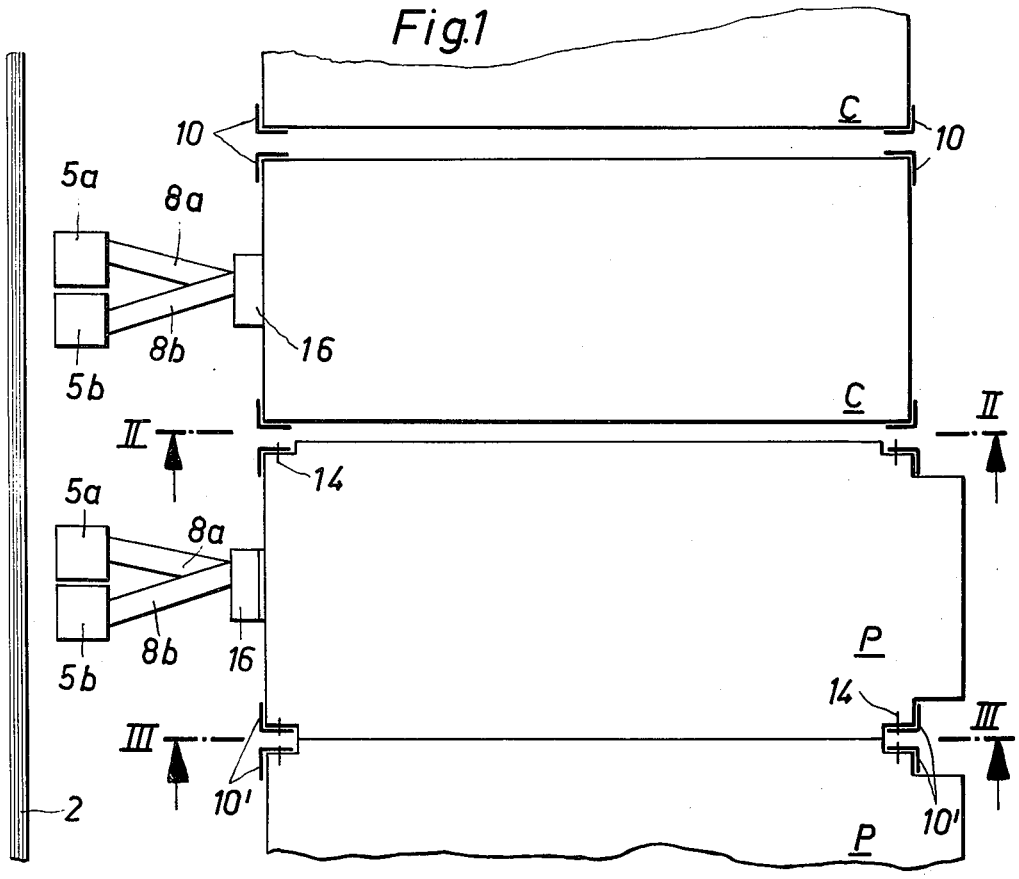
FIG. 1 is a simplified view of a cargo hold of a cargo ship provided with a ventilation arrangement, and in which for ease of demonstration both containers and pallets with other non-bulk cargo are shown to be arranged in container guides.

FIG. 1 is a simplified plan view of a hold space of the ship in which there are located a plurality of vertically arranged trunk-like container guides preferably formed by vertical guide rails 10 arranged at the corners of a rectangle. The rails extend vertically in the hold, preferably from the innerbottom of the ship to adjacent suitable hatches in the ship's weatherdeck which, in the usual case, defines the upper limit of the hold. Either containers C loaded with freight which is to be cooled or ventilated, or pallets P bearing non-bulk cargo L, which likewise is either to be cooled or ventilated, can, at will, be introduced from above, as through the ship's hatches, into these guide rails 10.

Pallets in adjacent container guides can form continuous loading planes or levels. That is, the hold is not vertically subdivided by permanent deck structures. The pallets can be supported at specified levels in the hold in such manner that the several pallets define the equivalent of one or more decks in the hold. However, it will be appreciated that depending upon how cargo is loaded on the various pallets, and depending upon the nature of the cargo itself, the pallets can be disposed at various levels in the hold space.

Figure 4:
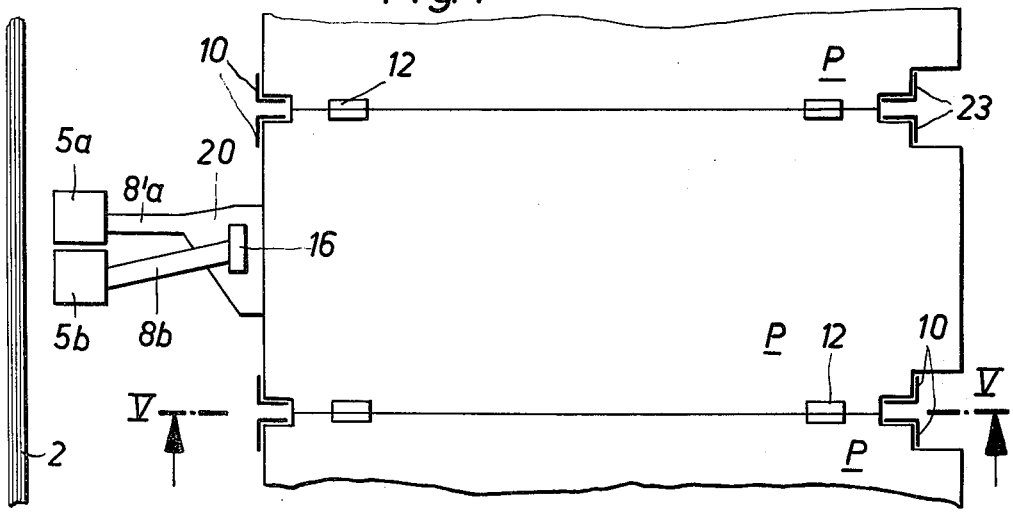
FIG. 4 is a plan view of another ventilation arrangement and shows pallets fitted into the container guides.
Figure 3:
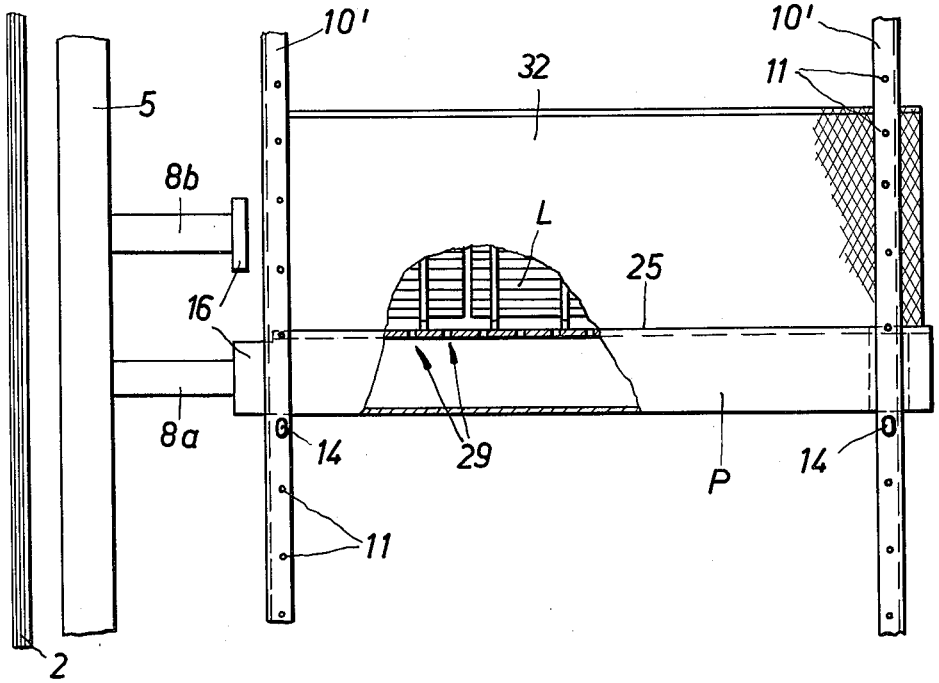
FIG. 3 is a view taken along line III—III in FIG. 1.
Figure 5:
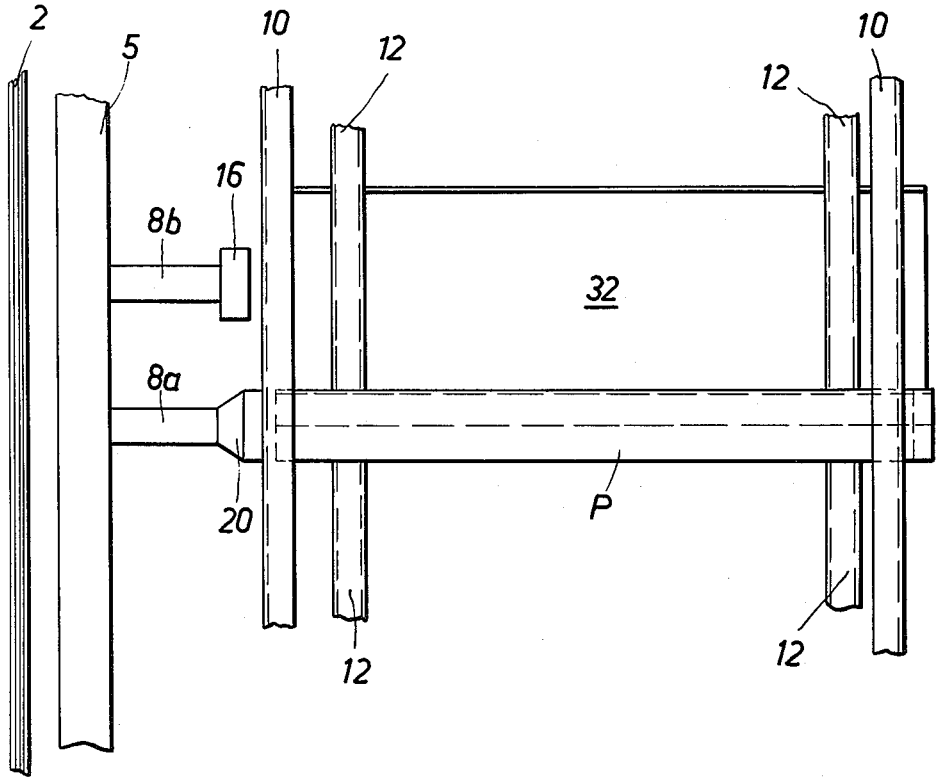
FIG. 5 is a side view taken along line V—V in FIG. 4.

While the standard containers C are advantageously supported one upon the other in a stacked manner between the top and bottom of the hold, it is necessary to support the individual pallets P in their guides. As shown in FIG. 3, the vertical guide rails (which are shown here at 10') are formed with holes 11 at intervals along the vertical extent of the rails. Bolts 14 or suitable pins are pushed into selected ones of these holes in order to support a pallet P thereon at the required height above the bottom of the hold or above the subjacent pallet. As an alternative, as shown in FIG. 5, the pallets P can also be supported by fitted support members 12 relative to the bottom of the hold and to other pallets. The support members may have the positions shown in FIGS. 4 and 5 or other positions, for example, close to the corners of the pallets. Support members 12 can be provided in various lengths desired separate from the pallets, or they can be fixedly or hingedly mounted on the pallets.

Figure 2:
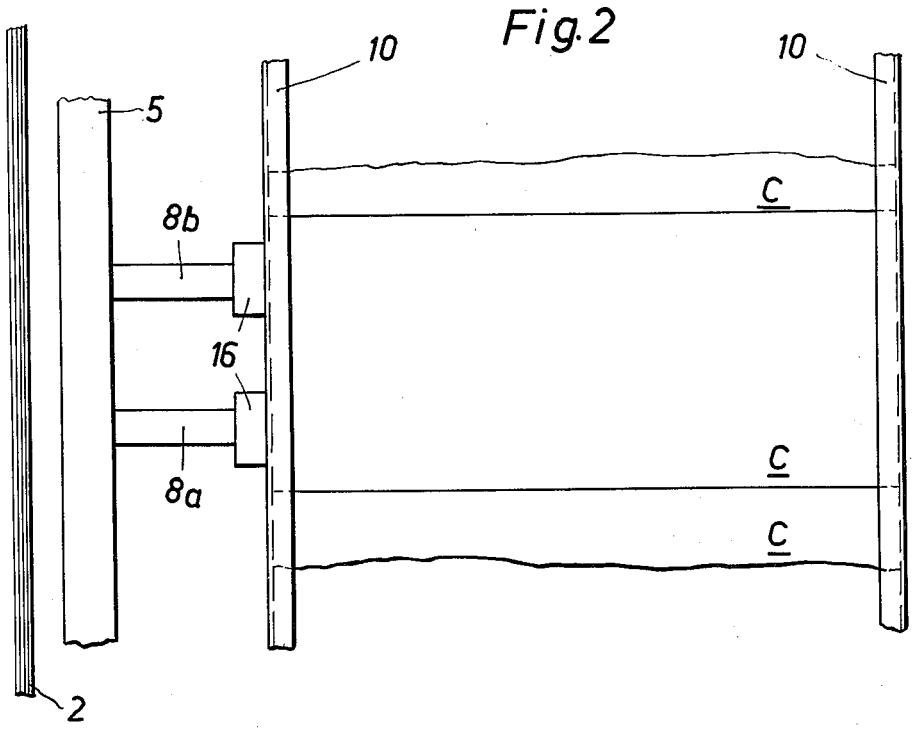
FIG. 2 is a view taken along line II—II in FIG. 1.

Only one internal vertical partition 2 of the transport ship, to which the ventilation arrangement described herein belongs, is shown in the drawings. Located in the ship is at least one ventilation source. The source provides one or more air circulation systems in the ship either with cooling air or fresh air. Where refrigeration is desired, the ventilation source includes a suitable refrigeration plant. Each air circulation system includes vertical (FIGS. 1 and 2) or horizontal transport ducts 5 which extend through the ship and which are respectively divided into air supply ducts **5*a* and exhaust air ducts 5*b*. The standard containers C which are to be ventilated and which are in the vertical guide rails 10 (see the top of FIGS. 1 and 2), each have an air inlet (not shown) at the end, which inlet is connected by means of a releasable coupling 16 and a connecting pipe 8*a* to an adjacent air duct 5*a*. Preferably each standard container also has an associated air outlet (not shown) which is connected through a similar coupling 16 and a connecting pipe 8*b* to an adjacent exhaust air duct 5*b*. These connecting elements 8*a*, 8*b* and 16, 16**, form the separate connections of the ventilation arrangement which are available for each standard container C.

The separate air circulation connections described above in regard to containers C can be used in like manner for the ventilation of pallets P arranged in the container guides; this case is represented in the bottom of FIG. 1 and in FIG. 3. The coupling 16 of the connecting pipe **8*a* of the air duct 5*a* is releasably connected to an air inlet in the end of the pallet P. As shown in FIG. 3, each pallet P has a hollow ventilation base, and each base has a top load-bearing surface 25. The pallet bases are of standardized plan configuration and dimension and are similar to the plan outlines of standard containers C. The air introduced through the coupling 16 into the ventilation base is distributed beneath the load-bearing surface 25 and is delivered through such surface through openings 29 to the vicinity of cargo carried on the load-bearing surface. Openings 29 can be formed as holes, slots or in a similar manner. Additional openings 29** can be provided in the side walls of the pallet P, if desired. Save for the air inlet and outlet openings, the pallet bases are closed.

The coupling 16 associated with the connecting pipe **8*b* of the exhaust air duct 5*b*, as shown in FIG. 3**, is spaced a short distance from but alongside the cargo L at the end of the pallet for drawing in and exhausting air emerging from the volume occupied by the cargo L.

Spaces, such as corner cut-outs 23 (see FIG. 4) which remain between adjacent pallets P can when required, remain completely open or can be closed by separate sealing means, which are not shown.

Enclosures 32 (see FIG. 3) serve to secure the cargo L on the pallets P against any slipping. The enclosures preferably are formed with openings or perforations so that the exchange of air is not impeded. The enclosures 32 may expediently consist of expanded metal, wire fabrics, meshes, perforated sheet metal plates or the like of the required strength. The enclosures 32, as illustrated in FIGS. 3 and 5, can be secured on the load-bearing surface 25 of the pallet P so as to be capable of being removed or swung out, and thus can be lifted into or removed from the container guides together with the pallet and its load L. To enable loading of cargo onto the pallet, the enclosure 32 may be completely or partly removed.

As an alternative to the enclosures for the individual pallets, the container guides may be provided with a suitable air flow enabling enclosure or fencing arrangement which is then disposed between the guide rails 10.

The enclosures or fencing means can be made closed on some of the sides of the pallet, i.e., without openings, so as to influence the air circulation in the manner required or, if desired, they can be arranged as insulating walls.

The pallets P can be provided with transport fittings and/or openings for the engagement of fork-lift trucks, these openings obviously being sealed off from the interior of each ventilation base which serves as a plenum for flow of air from the air supply ducts to the cargo areas of the pallets.

If desired, the connections for coupling the air supply and exhaust ducts to the containers or the pallets can be flexible ducts. Flexible ducts are especially useful with the pallets to enable the pallets to be supported at various elevations in their supporting frames.

Figure 6:
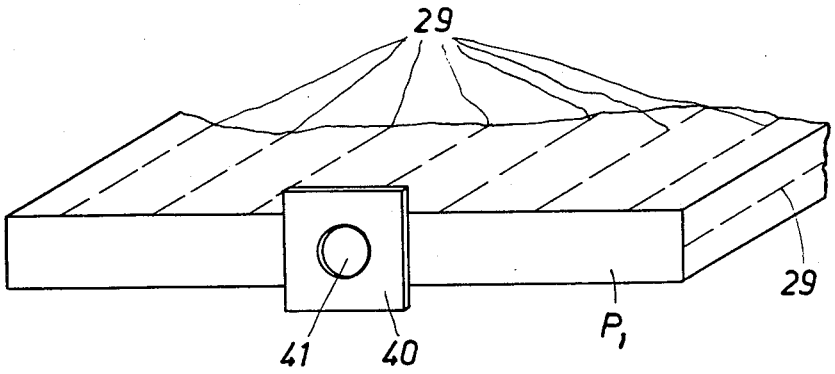
FIG. 6 is a simplified perspective partial view of a pallet.
Figure 7:
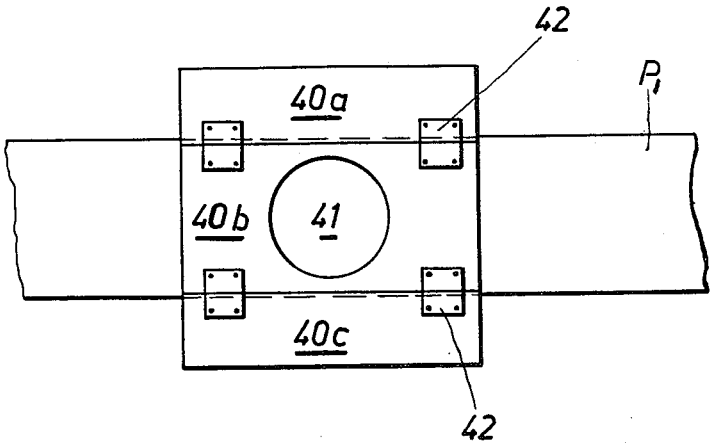
FIG. 7 is a partial end view of a pallet with a connecting plate.
Figure 8:
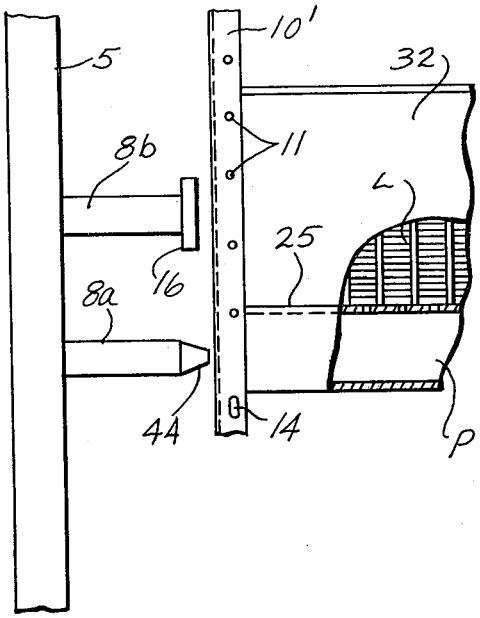
FIG 8 is a view similar to FIG. 3 showing an indirect coupling of a ship air supply duct to a pallet via a nozzle.

Pallets $P_1$, which do not have bases of a sufficient height for direct connection to the air supply ducts 5*a*, as are preferred for stowing reasons are provided at one of their ends with a connecting plate 40, as shown diagrammatically in FIG. 6. The connector plate 40 has an opening 41 for the passage of air from an air supply duct 5*a* into the ventilation base. The connecting plate 40 and the opening 41 have dimensions which permit the fitting of the couplings 16 thereon and an adequate passage for air into the ventilation base. In order that it be possible to stack the pallets $P_1$, the connecting plates 40 are mounted on the pallets so that they can be removed or hinged; One such example is shown in FIG. 7 in which the connecting plate is divided into three segments 40*a*, 40*b*, 40*c*. The segments 40*a* and 40*c* are to be moved by means of hinges 42 from the extended position as shown, in which they are secured by devices not illustrated, into a hinged position in which together they cover the opening 41. Alternatively, the connecting plate 40 can be mounted by sliding bolts or the like on the pallet $P_1$, and, after removal from the pallet base, can be pushed into a storage compartment (not shown) in the pallet. Further, it is possible for the connecting plate 40 to be made so that it can be hinged in the region of one of its edges, and in this case care is to be taken that the then undetachable connecting plate is pushed into an opening inside the pallet $P_1$.

If desired, the direct physical coupling of an air supply connecting pipe 8*a* to the air inlet opening of a container C or of a pallet P or $P_1$ can be replaced by an indirect coupling in the form of a nozzle 44 coupled to the air supply connecting pipe in spaced relation to the air inlet opening and arranged to direct supply air into the container or pallet base as received in the related guides 10 or 10'.

Workers skilled in the art to which this invention pertains will readily appreciate that the invention has been described above with reference to presently preferred procedures and structural arrangements for the purposes of example in furtherance of an explanation of the principles of the invention. The foregoing description is not exhaustive of all forms which the invention may take. Modifications, variations and alterations in the arrangements and procedures described above may be practiced without departing from the scope of this invention while relying on and taking of the advances it provides. Accordingly, the foregoing description should not be considered as limiting the scope of this invention.

What is claimed is:

1. A ventilation arrangement for an enclosed hold space of a cargo ship comprising at least one air circulation system by which air can be conveyed from a ventilation source through air supply ducts into a ship cargo hold space and can be returned as exhaust air through exhaust ducts to the ventilation source, a plurality of pallets each having a hollow ventilation base defining a top load-bearing surface for support of cargo thereon, guide means in the hold space for receiving corners of the pallet bases and for aligning the pallet bases with outlet openings from the air supply ducts, the guide means also being cooperable with standard cargo containers for receiving and aligning the containers with the air supply duct outlet openings, each pallet base having at an end thereof into the interior thereof an air inlet opening cooperable with a supply duct outlet opening for air flow into the pallet base from a supply duct, each pallet base also having at least through the load-bearing surface thereof air flow opening means from the base interior.

2. Apparatus according to claim 1 wherein connecting elements are provided for connecting the air circulation system to standard cargo containers and pallet bases received in the guide means, each connecting element comprising connecting duct means from the supply air ducts and to the exhaust air ducts respectively, and at least one coupling for connecting an air supply connecting duct means to a pallet base air inlet opening.

3. Apparatus according to claim 1 including releasable projection means cooperable with the guide means supporting the pallet bases individually in said guide means.

4. Apparatus according to claim 3 wherein the projection means are cooperable with the said guide means at selected locations spaced vertically in the guide means.

5. Apparatus according to claim 1 wherein the guide means extend vertically in the hold for defining prescribed lateral positions of containers and pallets, and including support members engageable between one pallet base and an adjacent base received in a given set of guide means for supporting the bases in vertically spaced relation in the guide means.

6. Apparatus according to claim 5 wherein the support members are separable from the pallet bases.

7. Apparatus according to claim 5 wherein the support members are carried by the pallet bases.

8. Apparatus according to claim 1 wherein the exhaust ducts have inlet openings thereinto, and the exhaust ducts, the guide means and the pallets are cooperatively related so that the exhaust duct inlet openings are spaced closely adjacent cargo carried on pallets received in the guide means.

9. Apparatus according to claim 1 or 2 including means for individually supporting pallets received in the guide means at selected vertical levels in the guide means whereby the received pallets are disposed in specified levels in the hold space with spaces remaining between the pallets.

10. Apparatus according to claim 9 including sealing means for filling the spaces along the sides of pallets.

11. Apparatus according to any one of claims 1 through 6 or 8 in which the air supply ducts are flexible proximately adjacent the outlet openings thereof.

12. Apparatus according to any one of claims 1 through 6 or 8 including enclosure means associated with at least some of the sides of at least some of the pallets for securing cargo loaded on the pallet from shifting laterally from the pallet.

13. Apparatus according to claim 12 wherein at least a portion of each pallet enclosure is effectively perforate for flow of air therethrough.

14. Apparatus according to any one of claims 1 through 6 or 8 including enclosing means carried by the guide means on at least some of the sides thereof.

15. Apparatus according to claim 1 wherein one side of each pallet base has arranged thereon a connecting plate formed with an opening leading into the base, the connecting plate being engageable with a coupling to an air supply duct.

16. Apparatus according to claim 15 wherein the connecting plate is releasably connected to the pallet.

17. Apparatus according to claim 1 wherein a connection of an air supply duct to a pallet base is formed by a nozzle coupled to the supply duct and directed into the opening in the pallet base as received in a guide means.

18. A marine cargo pallet comprising a hollow base of standardized substantially rectangular plan configuration and dimension, an air inlet opening laterally into the base interior at one end thereof, the structure of the pallet defining the air inlet opening being substantially flush with the adjacent end of the base so as not to project significantly laterally therefrom, the base having a top load-bearing surface, and air flow outlet opening means at least through the base top surface from the interior of the base, the base being closed save for the opening and the opening means to serve as a plenum for flow of air therethrough from the opening to the opening means.

19. A ventilation arrangement for a cargo ship comprising at least one air circulation system by which air can be conveyed from a ventilation source through air supply ducts into a ship cargo hold space and can be returned as exhaust air through exhaust ducts to the ventilation source, a plurality of pallets each having a hollow ventilation base defining a top load-bearing surface, container guide means in the hold space for receiving and aligning the pallet bases with outlet openings from the air supply ducts, the guide means also being cooperable with standard cargo containers for receiving and aligning the containers with the air supply duct outlet openings, each pallet base having at an end thereof into the interior thereof an opening cooperable with a supply duct outlet opening, each pallet base also having at least through the load-bearing surface thereof air flow opening means from the base interior, a connecting plate carried by each pallet base at said end thereof and through which the opening is formed, each connecting plate being formed as a support for a coupling to an air supply duct, each connecting plate being hingedly mounted on the pallet base.

20. A ventilation arrangement for a cargo ship comprising at least one air circulation system by which air can be conveyed frm a ventilation source through air supply ducts into a ship cargo hold space and can be returned as exhaust air through exhaust ducts to the ventilation source, a plurality of pallets each having a hollow ventilation base defining a top load-bearing surface, container guide means in the hold space for receiving and aligning the pallet bases with outlet openings from the air supply ducts, the guide means also being cooperable with standard cargo container for receiving and aligning the containers with the air supply duct outlet openings, each pallet base having at an end thereof into the interior thereof an opening cooperable with a supply duct outlet opening, each pallet base also having at least through the load-bearing surface thereof air flow opening means from the base interior, a connecting plate carried by each pallet base at said end thereof and through which the opening is formed, each connecting plate being formed as a support for a coupling to an air supply duct, each connecting plate consisting of three segments of which a middle segment has the opening formed therethrough and is fixed on the pallet base, and of which each of two outer segments are hinged on the middle segment, the outer segments together having a height equal to or less than the height of the middle segment.

21. A cargo support pallet adapted for use in ventilated hold spaces of a marine vessel and the like in which are provided forced air circulation mechanisms including air supply ducts having outlet openings at selected locations relative to vertical guides for cargo supporting pallets, the pallet comprising a hollow structural base of standardized substantially rectangular plan configuration and dimension, an air inlet opening into the base interior at one end thereof, a coupling mechanism cooperable with the base in association with the air inlet opening operable for establishing an air flow connection to the inlet opening from an air supply duct outlet opening, the structure of the pallet defining the air inlet opening being substantially flush with the adjacent end of the base so as not to project significantly laterally therefrom, the base being closed and having a top load-bearing surface which is essentially closed except for the presence therein at selected spaced locations of air flow outlet openings to the exterior of the base from the interior thereof, whereby when the base is coupled by the coupling mechanism to an air supply duct the base serves as a plenum for flow of air therethrough to the top surface air flow openings and to cargo on the top surface.

22. A ventilation arrangement for an enclosed hold space of a cargo ship comprising at least one air circulation system by which air can be conveyed from a ventilation source through air supply ducts into a ship cargo hold space and can be returned as exhaust air through exhaust ducts to the ventilation source, a plurality of pallets each having a hollow ventilation base defining a top load-bearing surface, container guide means in the hold space for receiving corners of the pallet bases and for aligning the pallet bases with outlet openings from the air supply ducts, the guide means also being cooperable with standard cargo containers for receiving and aligning the containers with the air supply duct outlet openings, each pallet base having proximate an end thereof into the interior thereof an inlet opening cooperable with a supply duct outlet opening, each pallet base also having at least through the load-bearing surface thereof air flow opening means from the base interior, coupling means cooperable with the base inlet opening for coupling to an air supply duct and for communicating air from a coupled air supply duct to the inlet opening and into the base interior.

* * * * *